US011682866B2

(12) United States Patent
Uemura

(10) Patent No.: US 11,682,866 B2
(45) Date of Patent: Jun. 20, 2023

(54) ELECTRICAL CONNECTOR WITH A CONDUCTIVE INTERPOSING MEMBER TO BE MOUNTED ON A SHIELDED CABLE

(71) Applicant: SUMITOMO WIRING SYSTEMS, LTD., Mie (JP)

(72) Inventor: Takuya Uemura, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/497,068

(22) Filed: Oct. 8, 2021

(65) Prior Publication Data

US 2022/0131319 A1 Apr. 28, 2022

(30) Foreign Application Priority Data

Oct. 27, 2020 (JP) ..... JP2020-179790

(51) Int. Cl.

| | |
|---|---|
| ***H01R 13/6592*** | (2011.01) |
| ***H01R 13/6582*** | (2011.01) |
| ***H01R 13/40*** | (2006.01) |
| ***H01R 13/639*** | (2006.01) |
| ***H01R 9/05*** | (2006.01) |
| ***H01R 13/6593*** | (2011.01) |
| *H01R 103/00* | (2006.01) |
| *H01R 13/6581* | (2011.01) |
| *H01R 13/74* | (2006.01) |

(52) U.S. Cl.

CPC ..... *H01R 13/6592* (2013.01); *H01R 9/0518* (2013.01); *H01R 13/40* (2013.01); *H01R 13/639* (2013.01); *H01R 13/6582* (2013.01); *H01R 13/6593* (2013.01); *H01R 13/6581* (2013.01); *H01R 13/748* (2013.01); *H01R 2103/00* (2013.01); *H01R 2201/26* (2013.01)

(58) Field of Classification Search

CPC .. H01R 13/6592; H01R 9/0518; H01R 13/40; H01R 13/639; H01R 13/6582; H01R 13/6593; H01R 13/6581; H01R 13/748; H01R 2103/00; H01R 2201/26

See application file for complete search history.

(56) References Cited

U.S. PATENT DOCUMENTS

2013/0078835 A1* 3/2013 Gunreben ..... H01R 13/70 439/188

FOREIGN PATENT DOCUMENTS

JP 2004-296418 A 10/2004

* cited by examiner

*Primary Examiner* — Abdullah A Riyami
*Assistant Examiner* — Justin M Kratt
(74) *Attorney, Agent, or Firm* — Venjuris, P.C.

(57) ABSTRACT

A shield connection structure includes a shielded cable 20, a conductive interposing members 40 to be mounted on the shielded cable 20, a conductive inner shell 50 for covering the interposing member 40, a conductive annular outer shell 60 for covering the inner shell 50, and a retainer 80 made of synthetic resin and to be mounted in the outer shell 60. The interposing member 40 contacts an electromagnetic shield member 23 exposed from an insulation coating 24 and the inner shell 50 and electrically connects the electromagnetic shield member 23 and the inner shell 50. The inner shell 50 contacts the interposing member 40 and the outer shell 60 and electrically connects the interposing member 40 and the outer shell 60. The retainer 80 holds the inner shell 50 with the inner shell 50 held in contact with an inner surface of the outer shell 60.

9 Claims, 7 Drawing Sheets

ELECTRICAL CONNECTOR WITH A CONDUCTIVE INTERPOSING MEMBER TO BE MOUNTED ON A SHIELDED CABLE

CROSS-REFERENCE TO RELATED APPLICATIONS

This application is based on and claims priority from Japanese Patent Application No. 2020-179790, filed on Oct. 27, 2020, with the Japan Patent Office, the disclosure of which is incorporated herein in their entireties by reference.

TECHNICAL FIELD

The present disclosure relates to a shield connection structure and a connector.

BACKGROUND

Conventionally, some of wiring harnesses to be routed inside a vehicle such as an automotive vehicle are known to include a shielded cable (see, for example, Japanese Patent Laid-open Publication No. 2004-296418). The shielded cable includes a conductive core, a sheath for surrounding the outer periphery of the core, a braided wire for surrounding the outer periphery of the sheath and an insulation coating for surrounding the outer periphery of the braided wire. In an end part of the shielded cable, a shield ring made of metal is mounted on the outer periphery of the braided wire and a conductive shielding body is integrated with the shield ring. The conductive shielding body is provided to electrically and mechanically connect a metal shield shell of a connector provided on an end part of the wiring harness and the shield ring. The shield shell is, for example, held inside a tubular outer housing of the connector.

SUMMARY

If the outer housing is made of metal, it is difficult to set a complicated structure for holding the shield shell in the outer housing. It is also difficult to set a complicated structure for holding the shield shell made of metal in the outer housing in the shield shell. Thus, if the outer housing is made of metal, the shield shell cannot be suitably held in the outer housing. In this case, since a contact state of the outer housing and the shield shell cannot be maintained, there is a problem of reducing shielding performance by the shield shell and the like.

The present disclosure aims to provide a shield connection structure and a connector capable of suppressing a reduction in shielding performance.

The present disclosure is directed to a shield connection structure with a shielded cable, a conductive interposing member to be mounted on the shielded cable, a conductive inner shell for covering the interposing member, a conductive annular outer shell for covering the inner shell, and a retainer made of synthetic resin, the retainer being mounted into the outer shell, wherein the shielded cable includes a conductive core, an insulating sheath for surrounding an outer periphery of the core, a conductive electromagnetic shield member for surrounding an outer periphery of the sheath and an insulating insulation coating for surrounding an outer periphery of the electromagnetic shield member, the interposing member contacts the electromagnetic shield member exposed from the insulation coating and the inner shell and electrically connects the electromagnetic shield member and the inner shell, the inner shell contacts the interposing member and the outer shell and electrically connects the interposing member and the outer shell, and the retainer holds the inner shell with the inner shell held in contact with an inner surface of the outer shell.

The present invention is directed to a connector with a conductive interposing member to be mounted on a shielded cable, a conductive inner shell for covering the interposing member, a conductive annular outer shell for covering the inner shell, and a retainer made of synthetic resin, the retainer being mounted into the outer shell, wherein the shielded cable includes a conductive core, an insulating sheath for surrounding an outer periphery of the core, a conductive electromagnetic shield member for surrounding an outer periphery of the sheath and an insulating insulation coating for surrounding an outer periphery of the electromagnetic shield member, the interposing member contacts the electromagnetic shield member exposed from the insulation coating and the inner shell and electrically connects the electromagnetic shield member and the inner shell, the inner shell contacts the interposing member and the outer shell and electrically connects the interposing member and the outer shell, and the retainer holds the inner shell with the inner shell held in contact with an inner surface of the outer shell.

According to the shield connection structure and the connector of the present disclosure, an effect of being capable of suppressing a reduction in shielding performance is achieved.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
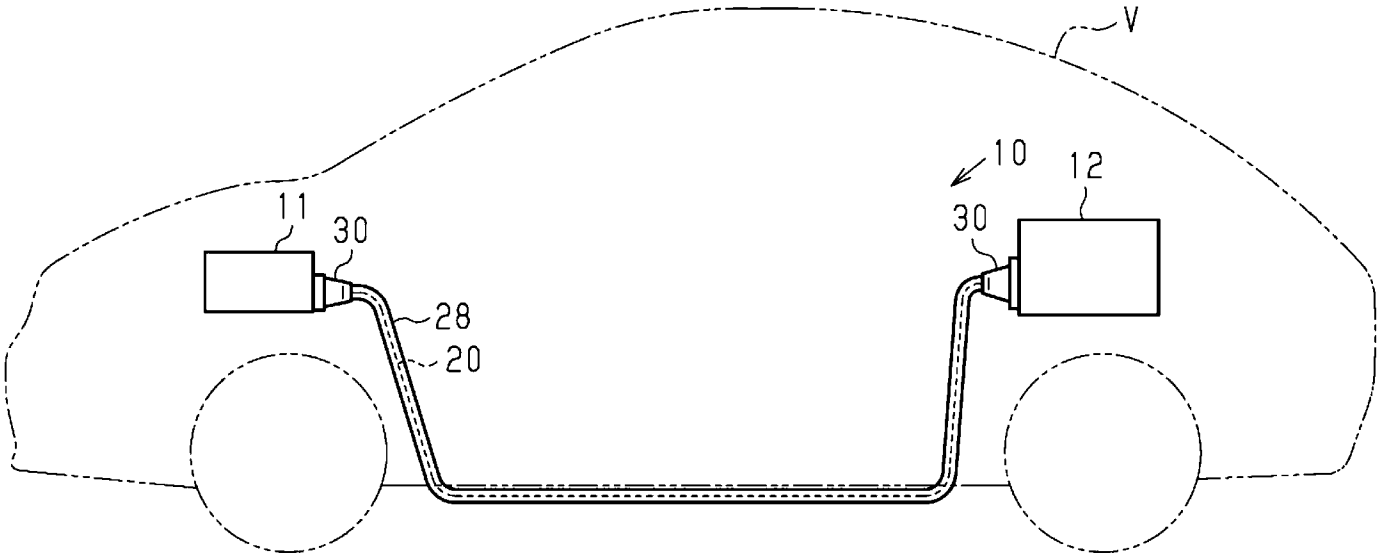
FIG. 1 is a schematic configuration diagram showing a wiring harness of one embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

[1] The shield connection structure of the present disclosure includes a shielded cable, a conductive interposing member to be mounted on the shielded cable, a conductive inner shell for covering the interposing member, a conductive annular outer shell for covering the inner shell, and a retainer made of synthetic resin, the retainer being mounted into the outer shell, wherein the shielded cable includes a conductive core, an insulating sheath for surrounding an outer periphery of the core, a conductive electromagnetic shield member for surrounding an outer periphery of the sheath and an insulating insulation coating for surrounding an outer periphery of the electromagnetic shield member, the interposing member contacts the electromagnetic shield member exposed from the insulation coating and the inner shell and electrically connects the electromagnetic shield member and the inner shell, the inner shell contacts the interposing member and the outer shell and electrically connects the interposing member and the outer shell, and the retainer holds the inner shell with the inner shell held in contact with an inner surface of the outer shell.

According to this configuration, the electromagnetic shield member and the inner shell are electrically connected by the interposing member, and the interposing member and the outer shell are electrically connected by the inner shell. In this way, the electromagnetic shield member is electrically connected to the outer shell via the interposing member and the inner shell. Further, the retainer holds the inner shell and is mounted in the outer shell with the inner shell held in contact with the inner surface of the outer shell. In this way, the inner shell can be held in contact with the inner surface of the outer shell by mounting the retainer made of synthetic resin into the outer shell. Thus, a contact state of the inner shell and the outer shell can be suitably maintained, wherefore a reduction in shielding performance by the inner shell, the outer shell and the like can be suitably suppressed. At this time, since the retainer made of synthetic resin is mounted in the outer shell, a structure of the outer shell for holding the retainer can be simple. In other words, structural restrictions of the outer shell can be relaxed.

Here, a "ring" in this specification means an entirely continuous and ring-shaped structure, i.e. means an end-less structure in which a start point and an end point coincide. Further, examples of the "ring" in this specification include circular rings having a circular outer edge shape, rings having an elliptical or oval outer edge shape, rings having a polygonal outer edge shape and rings having a rounded polygonal outer edge shape, and mean arbitrary closed shapes having an outer edge formed by connecting straight lines or curves. The "ring" means a shape having a through hole in a plan view and examples thereof include those in which an outer edge shape and an inner peripheral shape of a through hole are the same and those in which an outer edge shape and an inner peripheral shape of a through hole are different. Examples of the "ring" include those having a predetermined length along an axial direction in which a center axis passing through a center of a through hole extends, and the magnitude of the length does not matter. An "annular shape" in this specification may be regarded as a ring as a whole and examples thereof include annular shapes formed by combining a plurality of components and shapes partially including a cut, a slit or the like such as a C shape.

[2] Preferably, the outer shell includes a first engaging portion provided on the inner surface of the outer shell, and the retainer includes a second engaging portion to be engaged with the first engaging portion inside the outer shell. According to this configuration, the first engaging portion of the outer shell and the second engaging portion of the retainer are engaged inside the annular outer shell. Thus, an engaged part of the outer shell and the retainer is arranged inside the outer shell. In this way, unintended touch of a worker with the engaged part of the outer shell and the retainer, for example, during an assembling operation can be suppressed. Thus, unintended disengagement of the outer shell and the retainer can be suppressed and the detachment of the retainer from the outer shell can be suppressed. As a result, electrical disconnection of the inner shell held by the retainer and the outer shell can be suppressed. That is, the stability of electrical connection of the inner shell and the outer shell can be improved.

[3] Preferably, the inner shell is formed into an annular shape to be fit inside the outer shell, the inner shell has a first end surface and a second end surface in an axial direction of the inner shell, the retainer includes a first end part and a second end part in an axial direction of the retainer, the retainer includes a projecting portion formed to project outward from an outer surface of the first end part of the retainer, the projecting portion is engaged with the first end surface of the inner shell, and the second engaging portion is provided on the second end part of the retainer. According to this configuration, a movement of the inner shell in the axial direction is restricted by the engagement of the first end surface of the inner shell and the projecting portion of the retainer. In this way, the detachment of the inner shell from the outer shell can be suppressed.

[4] Preferably, the retainer is formed into an annular shape to be fit inside the inner shell, the retainer includes a cut portion provided in the second end part of the retainer, the cut portion is provided in a part of the retainer in a circumferential direction, and the interposing member is in contact with an inner surface of the inner shell exposed from the cut portion. According to this configuration, the annular retainer is fit into the inner shell. The inner shell can be held from inside the inner shell by this retainer. Further, by providing the retainer with the cut portion, the shield connection structure can be reduced in size as compared to the case where the retainer is not provided with the cut portion. For example, if the annular retainer is not provided with the cut portion, the retainer is interposed between the inner shell and the interposing member over the entire periphery in the circumferential direction of the retainer. Thus, a contact part of the inner shell and the interposing member needs to be shifted from the retainer in an axial direction of the shielded cable. Hence, if the retainer is not provided with the cut portion, the shield connection structure is enlarged in the axial direction of the shielded cable. In contrast, according to the above configuration, the interposing member can be held in contact with the inner surface of the inner shell exposed from the cut portion by providing the retainer with the cut portion. Thus, the contact part of the interposing member and the inner shell can be provided at a position overlapping the retainer in the axial direction of the shielded cable. In this way, the shield connection structure can be reduced in size in the axial direction of the shielded cable as compared to the case where the retainer is not provided with the cut portion.

[5] Preferably, the retainer includes an annular body portion, the body portion has a second end surface provided on the second end part of the retainer, the third end surface being an end surface in an axial direction of the body portion, the second engaging portion includes an engaging piece extending along the axial direction of the retainer from the third end surface of the body portion and projecting further than the second end surface of the inner shell, the engaging piece is provided on a part of the body portion in the circumferential direction, the engaging piece includes a base end part and a tip part in the axial direction of the retainer, the base end part of the engaging piece is connected to the third end surface of the body portion, the tip part of the engaging piece is engaged with the first engaging portion of the outer shell, and the cut portion is formed by the third end surface of the body portion and the engaging piece. According to this configuration, the cut portion of the retainer is formed by the third end surface of the annular body portion and the engaging piece formed to project from the part in the circumferential direction of the third end surface. That is, the cut portion of the retainer is formed in a part of the retainer in the circumferential direction where the engaging piece is not formed. The interposing member can be brought into contact with the inner surface of the inner shell exposed from this cut portion. Further, the engaging piece is formed to extend along the axial direction of the retainer from the third end surface of the body portion and project further than the second end surface of the inner shell. Thus, the inner shell can be held from inside also by the engaging piece in addition to the body portion. In this way, the inner shell can be suitably held from inside while the retainer is provided with the cut portion.

[6] Preferably, the body portion includes a first recess provided in the third end surface of the body portion, the first recess is provided in a part of the body portion in the circumferential direction, and a part of the interposing member is accommodated in the first recess. According to this configuration, the first recess capable of accommodating the part of the interposing member is provided in the body portion of the retainer. Thus, the interference of the retainer and the interposing member inside the inner shell can be suppressed. In this way, the part of the interposing member can be provided at a position overlapping the body portion in the axial direction of the shielded cable. As a result, the shield connection structure can be reduced in size in the axial direction of the shielded cable as compared to the case where the body portion is not provided with the first recess.

[7] Preferably, a plurality of the shielded cables pass through inside of the inner shell, the plurality of shielded cables are provided side by side along a first direction intersecting the axial direction of the shielded cables, and the engaging piece is provided in a clearance between the plurality of shielded cables in the first direction. According to this configuration, the engaging piece is provided in the clearance between the plurality of shielded cables. In other words, the engaging piece is provided in a dead space formed when the plurality of shielded cables are provided side by side in the first direction. Thus, the enlargement of the shield connection structure due to the provision of the retainer can be suppressed.

[8] Preferably, the retainer includes a restricting wall projecting inward from an inner surface of the first end part of the body portion, and the restricting wall is engaged with one end surface in the axial direction of the interposing member. According to this configuration, a movement of the interposing member in the axial direction is restricted by the engagement of the one end surface in the axial direction of the interposing member with the restricting wall of the retainer. In this way, the interposing member can be easily positioned in the axial direction inside the inner shell.

[9] Preferably, the first engaging portion is formed to project radially inwardly of the outer shell from the inner surface of the outer shell, the inner shell includes a second recess provided in the second end surface of the inner shell, and at least a part of the first engaging portion is accommodated in the second recess. According to this configuration, the inner shell is provided with the second recess capable of accommodating at least the part of the first engaging portion. Thus, the interference of the first engaging portion and the inner shell inside the outer shell can be suppressed. In this way, at least the part of the first engaging portion can be provided at a position overlapping the inner shell in the axial direction of the shielded cable. As a result, the shield connection structure can be reduced in size in the axial direction of the shielded cable as compared to the case where the inner shell is not provided with the second recess.

[10] The connector of the present disclosure includes a conductive interposing member to be mounted on a shielded cable, a conductive inner shell for covering the interposing member, a conductive annular outer shell for covering the inner shell, and a retainer made of synthetic resin, the retainer being mounted into the outer shell, wherein the shielded cable includes a conductive core, an insulating sheath for surrounding an outer periphery of the core, a conductive electromagnetic shield member for surrounding an outer periphery of the sheath and an insulating insulation coating for surrounding an outer periphery of the electromagnetic shield member, the interposing member contacts the electromagnetic shield member exposed from the insulation coating and the inner shell and electrically connects the electromagnetic shield member and the inner shell, the inner shell contacts the interposing member and the outer shell and electrically connects the interposing member and the outer shell, and the retainer holds the inner shell with the inner shell held in contact with an inner surface of the outer shell.

According to this configuration, the electromagnetic shield member and the inner shell are electrically connected by the interposing member, and the interposing member and the outer shell are electrically connected by the inner shell. In this way, the electromagnetic shield member is electrically connected to the outer shell via the interposing member and the inner shell. Further, the retainer holds the inner shell and is mounted in the outer shell with the inner shell held in contact with the inner surface of the outer shell. In this way, the inner shell can be held in contact with the inner surface of the outer shell by mounting the retainer made of synthetic resin into the outer shell. Thus, a contact state of the inner shell and the outer shell can be suitably maintained, wherefore a reduction in shielding performance by the inner shell, the outer shell and the like can be suitably suppressed. At this time, since the retainer made of synthetic resin is mounted in the outer shell, a structure of the outer shell for holding the retainer can be simple. In other words, structural restrictions of the outer shell can be relaxed.

Details of Embodiment of Present Disclosure

Specific examples of a shield connection structure and a connector of the present disclosure are described below with reference to the drawings. In each figure, configurations may be shown in a partially exaggerated or simplified manner for the convenience of description. Further, a dimension ratio of each part may be different in each figure. "Parallel" and "orthogonal" in this specification not only mean strictly parallel and orthogonal, but also mean substantially parallel and orthogonal within a range to achieve functions and effects in this embodiment. Note that the present invention is not limited to these illustrations and is intended to be represented by claims and include all changes in the scope of claims and in the meaning and scope of equivalents.

(Overall Configuration of Wiring Harness 10)

A wiring harness 10 shown in FIG. 1 electrically connects two, three or more electric devices 11, 12. The electric devices 11, 12 are installed in a vehicle V such as a hybrid or electric vehicle. Examples of the electric devices 11, 12 include a battery, an inverter, a motor, an air conditioner, a winker device, an airbag device and the like.

The wiring harness 10 includes one or more (two in this embodiment) shielded cables 20, an exterior member 28 for surrounding the plurality of shielded cables 20 and a pair of connectors 30 mounted on both end parts of the shielded cables 20. One end part of the shielded cable 20 is connected to the electric device 11 via the connector 30, and the other end part thereof is connected to the electric device 12 via the connector 30. The exterior member 28 protects the shielded cables 20 accommodated inside from flying objects and waterdrops.

Figure 2:
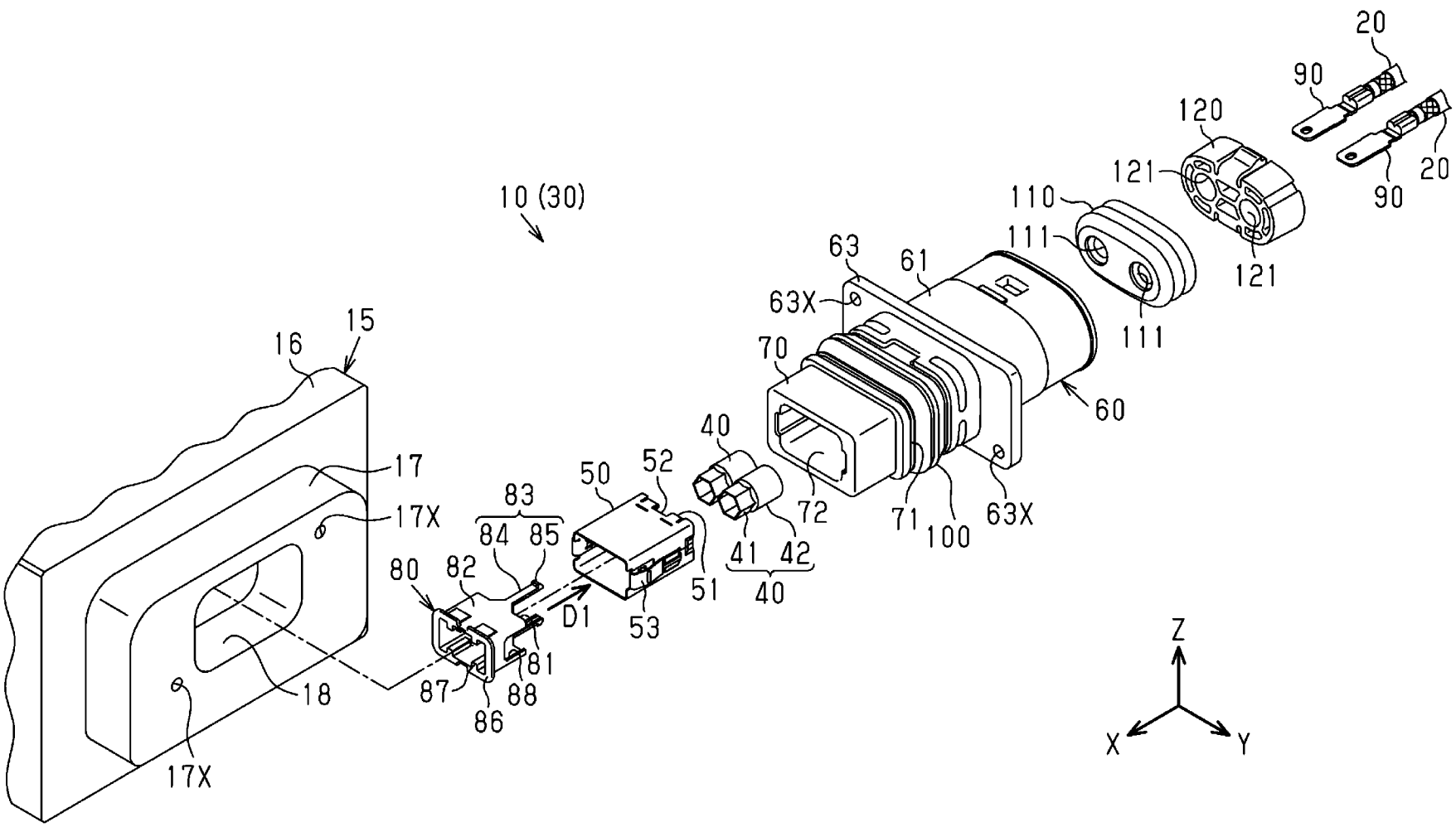
FIG. 2 is a schematic exploded perspective view showing a connector of the one embodiment.

As shown in FIG. 2, each connector 30 is fixed to a conductive case 15 of the electric device 11, 12 (see FIG. 1). Each connector 30 is, for example, electrically connected to a mating terminal provided in the case 15. For example, an iron-based or aluminum based metal material can be used as a material of the case 15.

(Configuration of Case 15)

The case 15 includes a box-like case body 16 and an annular mounting portion 17 integrally provided to the case body 16 and projecting outwardly of the case body 16. The mounting portion 17 is formed into an annular shape by having a mounting hole 18 penetrating through the mounting portion 17. The mounting hole 18 is, for example, formed into a flat shape having a long side direction and a short side direction when viewed from a penetration direction. In this specification, examples of the "flat shape" include rectangular shapes, oval shapes, elliptical shapes and the like. Examples of a "rectangular shape" in this specification include rectangular shapes with chamfered ridges and rectangular shapes with rounded ridges. The mounting hole 18 of this embodiment is formed into a rectangular shape when viewed from the penetration direction.

Note that, out X, Y and Z axes in each figure, the X axis represents an axial direction (front-rear direction) of the connector 30, the Y axis represents a width direction (lateral direction) of the connector 30 orthogonal to the X axis, and the Z axis represents a height direction (vertical direction) of the connector 30 orthogonal to an XY plane. In the following description, a direction extending along the X axis is referred to as an X-axis direction, a direction extending along the Y axis is referred to as a Y-axis direction and a direction extending along the Z axis is referred to as a Z-axis direction for the sake of convenience. In the following description, an X-arrow direction and a Z-arrow direction in FIG. 2 are a forward direction and an upward direction. That is, in the following description, a direction from the connector 30 toward the case 15 is defined as a forward direction.

The mounting portion 17 is provided with one or more fixing holes 17X for fixing the connector 30 to the case 15 by unillustrated bolt(s). In this embodiment, two fixing holes 17X are provided on opposite sides across the mounting hole 18.

(Configuration of Connector 30)

Figure 3:
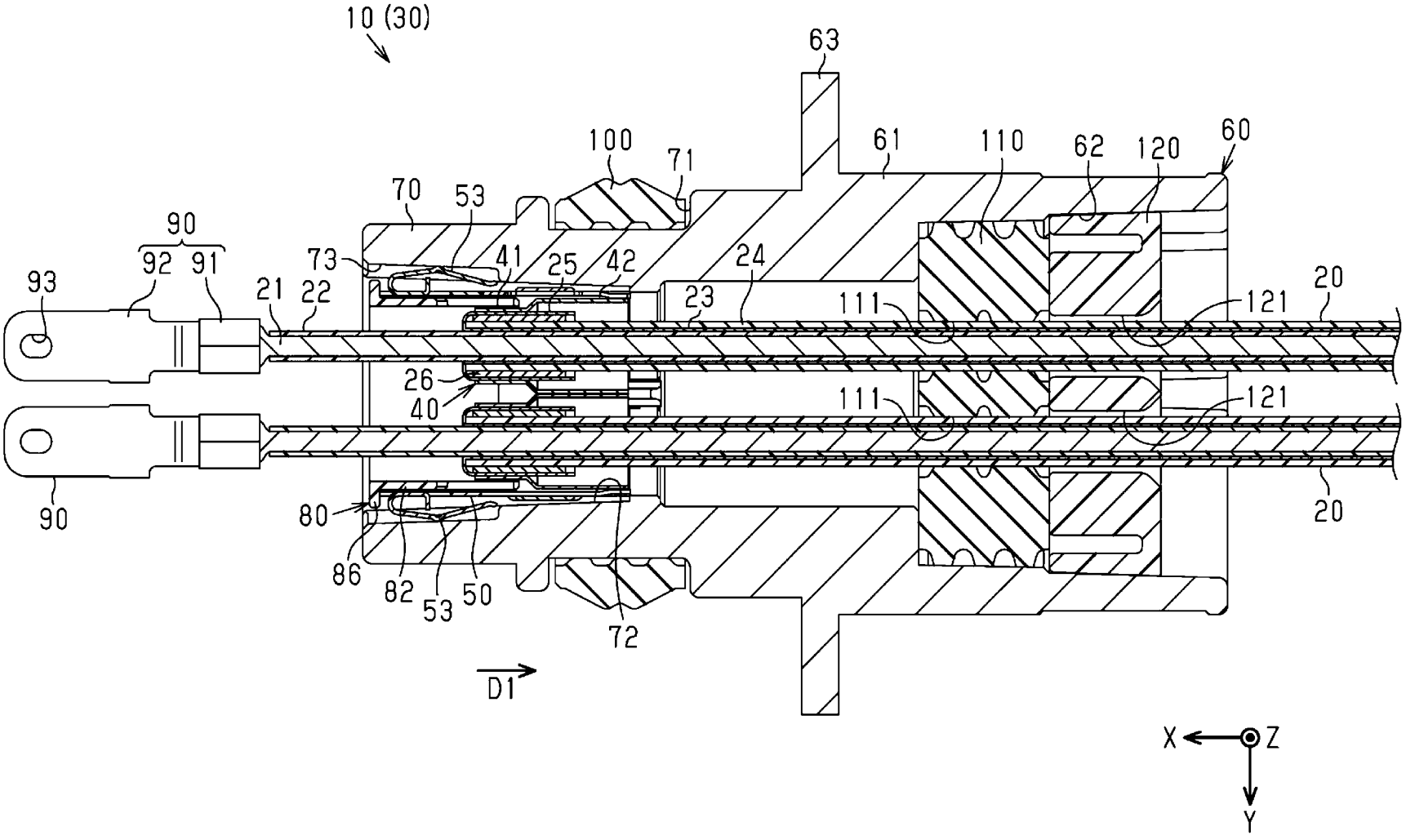
FIG. 3 is a schematic section showing the connector of the one embodiment.

As shown in FIGS. 2 and 3, the connector 30 includes conductive interposing members 40 to be mounted on the shielded cables 20, and a conductive inner shell 50 for covering the interposing members 40. The connector 30 includes a conductive annular outer shell 60 for covering the inner shell 50, and a retainer 80 made of synthetic resin and to be mounted into the outer shell 60. The connector 30 includes, for example, connection terminals 90 mounted on end parts of the shielded cables 20, a rubber ring 100 mounted on the outer periphery of the outer shell 60, a rubber plug 110 mounted in an end part of the outer shell 60, and a back retainer 120 for preventing the rubber plug 110 from coming out from the outer shell 60. Here, a shield connection structure is formed by the shielded cables 20, the interposing members 40, the inner shell 50, the outer shell 60 and the retainer 80.

(Configuration of Shield Cable 20)

Figure 4:
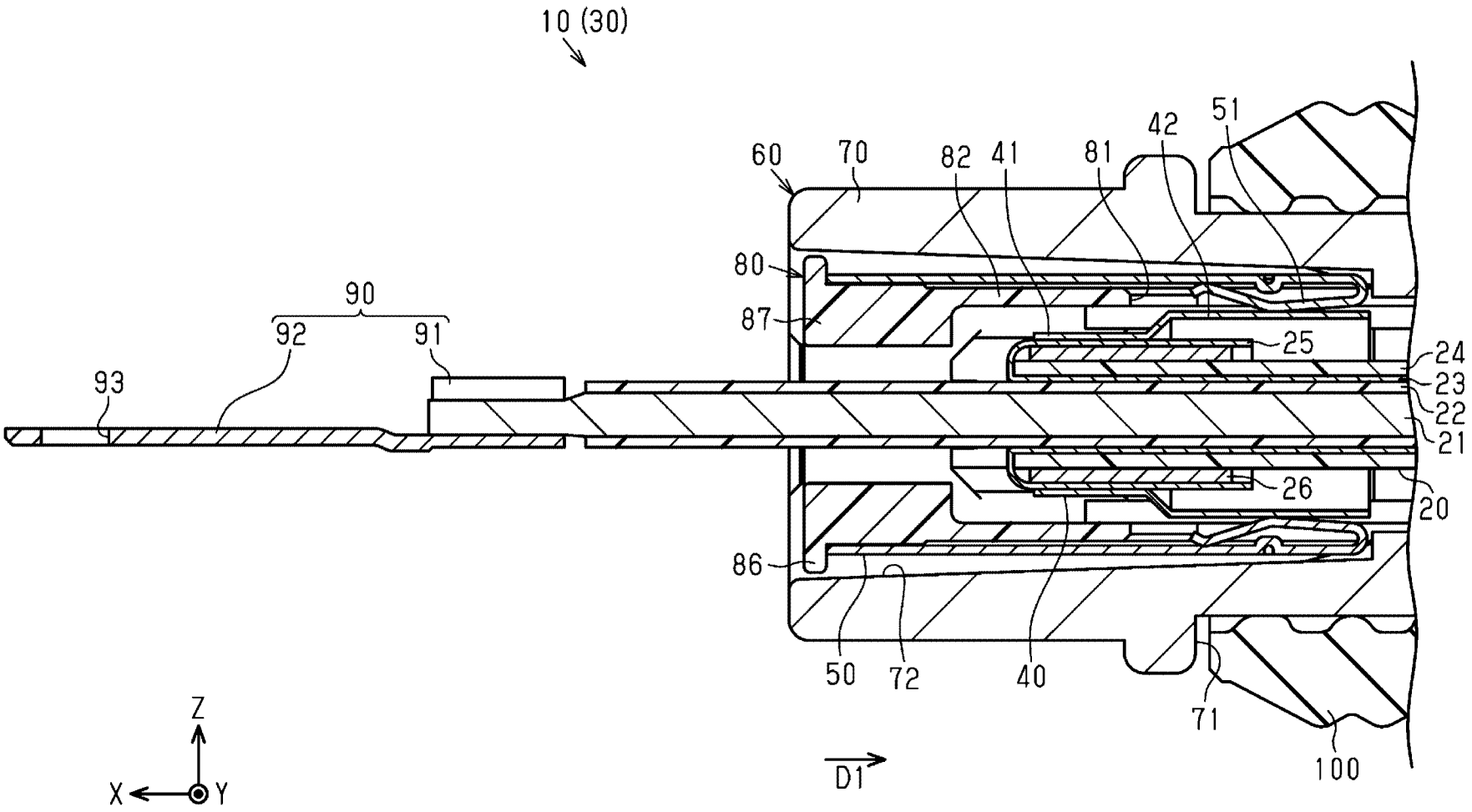
FIG. 4 is a schematic section showing the connector of the one embodiment.

As shown in FIG. 4, each shielded cable 20 includes a conductive core 21, an insulating sheath 22 for surrounding the outer periphery of the core 21, a conductive electromagnetic shield member 23 for surrounding the outer periphery of the sheath 22, and an insulating insulation coating 24 for surrounding the outer periphery of the electromagnetic shield member 23.

(Configuration of Core 21)

A stranded wire formed by twisting a plurality of metal strands, a columnar conductor formed of one columnar metal bar having a solid internal structure, a tubular conductor having a hollow internal structure and the like can be, for example, used as the core 21. Further, a stranded wire, a columnar conductor and a tubular conductor may be used in combination as the core 21. A copper-based or aluminum based metal material can be, for example, used as a material of the core 21.

(Configuration of Sheath 22)

The sheath 22 covers, for example, the outer peripheral surface of the core 21 over the entire periphery in a circumferential direction. The sheath 22 is, for example, made of an insulating material such as synthetic resin. A synthetic resin mainly containing a polyolefin-based resin such as cross-linked polyethylene or cross-linked polypropylene can be, for example, used as a material of the sheath 22.

(Configuration of Electromagnetic Shield Member 23)

The electromagnetic shield member 23 surrounds, for example, the outer peripheral surface of the sheath 22 over the entire periphery in the circumferential direction. The electromagnetic shield member 23 is, for example, flexible. A braided wire formed by braiding a plurality of metal strands into a tube or a metal foil can be, for example, used as the electromagnetic shield member 23. The electromagnetic shield member 23 of this embodiment is a braided wire. A copper-based or aluminum-based metal material can be, for example, used as a material of the electromagnetic shield member 23.

(Configuration of Insulation Coating 24)

The insulation coating 24 surrounds, for example, the outer peripheral surface of the electromagnetic shield member 23 over the entire periphery in the circumferential direction. The insulation coating 24 is, for example, made of an insulating material such as synthetic resin. A synthetic resin mainly containing a polyolefin-based resin such as cross-linked polyethylene or cross-linked polypropylene can be, for example, used as a material of the insulation coating 24.

An end part (here, front end part) in the axial direction of the core 21 is exposed from the sheath 22. The connection terminal 90 is connected to the front end part of the core 21 exposed from the sheath 22. The connection terminal 90 is, for example, provided forward of the front end surface of the outer shell 60.

(Configuration of Connection Terminal 90)

The connection terminal 90 includes, for example, a cable connecting portion 91 to be connected to a front end part of the shielded cable 20 and a terminal connecting portion 92 to be connected to an unillustrated mating terminal. Each connection terminal 90 is, for example, a single component in which the cable connecting portion 91 and the terminal connecting portion 92 are continuously and integrally formed. A metal material such as copper, copper alloy, aluminum, aluminum alloy or stainless steel can be used as a material of each connection terminal 90.

The cable connecting portion 91 is connected to the front end part of the core 21 exposed from the sheath 22. The cable connecting portion 91 is connected to the core 21, for example, by crimping, ultrasonic welding or the like. In this way, the cable connecting portion 91 and the core 21 are electrically and mechanically connected.

The terminal connecting portion 92 is, for example, in the form of a flat plate. A through hole 93 penetrating through the terminal connecting portion 92 in a plate thickness direction (here, Z-axis direction) is formed in a front end part of the terminal connecting portion 92. The terminal connecting portion 92 is electrically connected to the mating terminal, for example, by an unillustrated bolt inserted into the through hole 93.

(Configuration of Shielded Cable 20)

An end part (here, front end part) in the axial direction of the electromagnetic shield member 23 includes an exposed portion 25 exposed from the insulation coating 24. The exposed portion 25 is, for example, folded rearward. The exposed portion 25 is, for example, folded to cover the outer periphery of a front end part of the insulation coating 24. Here, an underlay member 26 is mounted on the front end part of the insulation coating 24. The underlay member 26 is, for example, formed into an annular shape surrounding the outer peripheral surface of the insulation coating 24 over the entire periphery in the circumferential direction. The exposed portion 25 is, for example, folded to cover the outer periphery of the underlay member 26. A folded part of the exposed portion 25 surrounds, for example, the outer peripheral surface of the underlay member 26 over the entire periphery in the circumferential direction. In other words, the underlay member 26 is provided between the outer peripheral surface of the insulation coating 24 and the inner peripheral surface of the folded part of the exposed portion 25. Note that a material having a higher rigidity than the insulation coating 24 can be, for example, used as a material of the underlay member 26. A copper-based or aluminum-based metal material can be, for example, used as a material of the underlay member 26.

(Configuration of Interposing Member 40)

The interposing member 40 is, for example, mounted on the outer periphery of the folded part of the exposed portion 25. The interposing member 40 is, for example, formed into an annular shape. The interposing member 40 surrounds, for example, the outer peripheral surface of the folded part of the exposed portion 25 over the entire periphery in the circumferential direction. The interposing member 40 is in contact with the exposed portion 25 and the inner shell 50. The interposing member 40 electrically connects the electromagnetic shield member 23 and the inner shell 50. A copper-based or aluminum-based metal material can be, for example, used as a material of the interposing member 40.

The interposing member 40 includes, for example, a crimping portion 41 to be connected to the exposed portions 25 and a connecting portion 42 to be connected to the inner shell 50. The interposing member 40 is, for example, integrally formed such that the crimping portion 41 and the connecting portion 42 are connected in an axial direction of the interposing member 40. The crimping portion 41 is formed into an annular shape. The connecting portion 42 is formed into an annular shape.

The crimping portion 41 is, for example, mounted on the folded part of the exposed portion 25 by being crimped to the folded part from outside. The interposing member 40 is mounted on the outer periphery of the electromagnetic shield member 23 by crimping the crimping portion 41 provided on one end part in the axial direction of the interposing member 40. In this way, the interposing member 40 is in contact with the outer peripheral surface of the exposed portion 25 and electrically connected to the electromagnetic shield member 23. Here, the crimping portion 41 is, for example, provided in a front end part in the axial direction of the interposing member 40. The crimping portion 41 is, for example, provided at a position where the underlay member 26 and the shielded cable 20 radially overlap. In other words, the underlay member 26 is provided radially inwardly of the exposed portion 25 at a position in the axial direction of the shielded cable 20 where the crimping portion 41 of the interposing member 40 is provided. In this way, when the crimping portion 41 is crimped to the folded part of the exposed portion 25, the deformation of the shielded cable 20 itself can be suppressed since the underlay member 26 is interposed between the exposed portion 25 and the insulation coating 24. As a result, the stability of electrical connection of the electromagnetic shield member 23 and the interposing member 40 can be improved.

The connecting portion 42 is, for example, provided in a rear end part in the axial direction of the interposing member 40. An opening width in the connecting portion 42 is, for example, larger than that in the crimping portion 41. The inner peripheral surface of the connecting portion 42 is, for example, not in contact with the outer peripheral surface of the exposed portion 25. For example, a clearance is provided between the inner peripheral surface of the connecting portion 42 and the outer peripheral surface of the exposed portion 25. The outer peripheral surface of the connecting portion 42 is, for example, in contact with the inner surface of the inner shell 50. In this way, the interposing member 40 is electrically connected to the inner shell 50.

(Configuration of Outer Shell 60)

As shown in FIG. 2, the outer shell 60 has an annular shape extending in the axial direction. The outer shell 60 includes, for example, an outer arrangement portion 61 arranged outside the case 15 and an inserting portion 70 to be inserted into the mounting hole 18 of the case 15. The inserting portion 70 is inserted forward into the mounting hole 18 from behind along the X-axis direction. The outer shell 60 is, for example, a single component in which the outer arrangement portion 61 and the inserting portion 70 are continuously and integrally formed in an axial direction (here, X-axis direction) of the outer shell 60. A copper-based, aluminum-based or iron-based metal material can be, for example, used as a material of the outer shell 60.

(Configuration of Outer Arrangement Portion 61)

As shown in FIG. 3, the outer arrangement portion 61 is formed to project rearward from the rear end of the inserting portion 70. The outer arrangement portion 61 is, for example, formed into an annular shape by having an accommodation hole 62 penetrating through the outer arrangement portion 61 in the X-axis direction. The outer arrangement portion 61 has an annular shape longer in the Y-axis direction than in the Z-axis direction when viewed from the X-axis direction. The outer arrangement portion 61 of this embodiment is formed into an oval annular shape.

As shown in FIG. 2, a fixing portion 63 projecting radially outward from the outer surface of the outer arrangement portion 61 is provided in a front end part of the outer arrangement portion 61. The fixing portion 63 is, for example, formed into an annular shape continuously extending over the entire outer periphery of the outer arrangement portion 61 in the circumferential direction. The fixing portion 63 is provided with two through holes 63X penetrating through the fixing portion 63 in the X-axis direction. The two through holes 63X are provided at positions corresponding to two fixing holes 17X of the case 15.

Here, when the connector 30 is fixed to the case 15, the inserting portion 70 is inserted into the mounting hole 18 and the fixing portion 63 is so laid on the mounting portion 17 that the respective through holes 63X overlap the respective fixing holes 17X in the X-axis direction. Then, the fixing portion 63 is fixed to the mounting portion 17 by bolts (not shown) inserted into the respective through holes 63X and the respective fixing holes 17S. In this way, the outer shell 60 is fixed to the case 15 and electrically connected to the case 15.

As shown in FIG. 3, the plurality of shielded cables 20 are accommodated inside the accommodation hole 62. The rubber plug 110 mounted on the outer peripheral surfaces of the insulation coatings 24 is, for example, accommodated inside the accommodation hole 62. The rubber plug 110 includes, for example, two through holes 111 penetrating in the X-axis direction. The respective shielded cables 20 are inserted through the respective through holes 111. The rubber plug 110 seals between the outer peripheral surfaces of the respective shielded cable 20 and the inner peripheral surface of the accommodation hole 62.

The back retainer 120 is, for example, accommodated in a rear end part of the accommodation hole 62. The back retainer 120 retains the rubber plug 110 in the outer shell 60, for example, by being held in contact with the rear end surface of the rubber plug 110 in the outer shell 60. The back retainer 120 includes, for example, two through holes 121 penetrating through the back retainer 120 in the X-axis direction. The respective through holes 12 are provided to overlap the respective through holes 111 in the axial direction. The respective shielded cables 20 are inserted through the respective through holes 121. Note that the respective shielded cables 20 are pulled out to outside from the rear end part of the outer shell 60 through the through holes 111, 112.

(Configuration of Inserting Portion 70)

As shown in FIG. 2, the inserting portion 70 is, for example, formed to project forward from the front end of the outer arrangement portion 61. The inserting portion 70 is formed into an annular shape having an outer peripheral surface shaped to correspond to the inner peripheral surface of the mounting hole 18. The outer and inner peripheral surfaces of the inserting portion 70 are formed into a rectangular shape longer in the Y-axis direction than in the Z-axis direction. The inserting portion 70 of this embodiment is formed into a rectangular annular shape.

An accommodation groove 71 is formed in the outer peripheral surface of the inserting portion 70. The accommodation groove 71 is formed to be recessed radially inwardly of the inserting portion 70 from the outer peripheral surface of the inserting portion 70. The accommodation groove 71 is, for example, formed on the outer periphery of the inserting portion 70 over the entire periphery in the circumferential direction. The rubber ring 100 is fit in the accommodation groove 71. The rubber ring 100 seals between the outer peripheral surface of the outer shell 60 and the inner peripheral surface of the case 15.

As shown in FIG. 3, the inserting portion 70 includes one or more (one in this embodiment) accommodation spaces 72. The accommodation space 72 is, for example, formed to penetrate through the inserting portion 70 in the X-axis direction. The inserting portion 70 is formed into an annular shape by having the accommodation space 72. The accommodation space 72 communicates with the accommodation hole 62. The inner shell 50 is held inside the accommodation space 72. The inner shell 50 is held inside the accommodation space 72 by the retainer 80. The plurality of shielded cables 20 and the plurality of interposing members 40 are accommodated inside the accommodation space 72. For example, connected parts of the respective shielded cables 20 and the respective interposing members 40 are accommodated inside the accommodation space 72. Here, the inner shell 50 and the retainer 80 are, for example, inserted into the accommodation space 72 along an inserting direction D1. The inserting direction D1 of this embodiment is a direction parallel to the X-axis direction and from front to rear in the X-axis direction. Further, the interposing member 40 is, for example, inserted into the accommodation space 72 along a direction opposite to the inserting direction D1, i.e. from rear to front in the X-axis direction while being mounted on the outer periphery of the shielded cable 20.

One or more (here, two) recesses 73 are, for example, provided in the inner surface of the accommodation space 72. The two recesses 73 are, for example, provided in the inner surface of the accommodation space 72 in a front end part of the inserting portion 70. The two recesses 73 are, for example, provided in two inner surfaces facing each other in the Y-axis direction, out of the inner surface of the accommodation space 72. Each recess 73 is formed to be recessed radially inwardly of the inserting portion 70 from the inner surface of the accommodation space 72. Here, "facing each other" in this specification indicates that surfaces or members are at positions in front of each other and means not only a case where surfaces or members are at positions perfectly in front of each other, but also a case where surfaces or members are at positions partially in front of each other. Further, "facing each other" in this specification means both a case where another member different from two parts is interposed between the two parts and a case where nothing is interposed between two parts.

Figure 5:
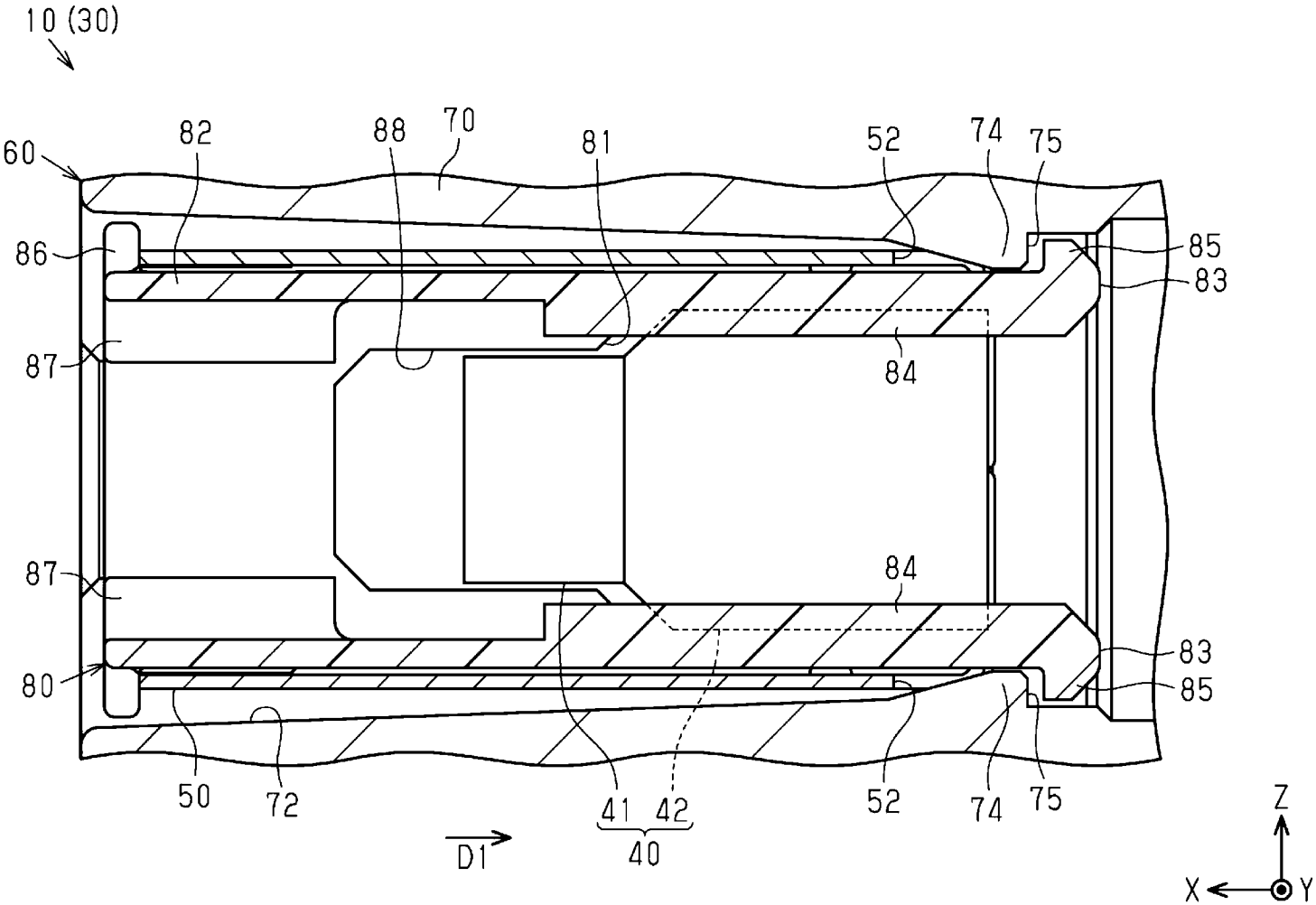
FIG. 5 is a schematic section showing the connector of the one embodiment.
Figure 6:
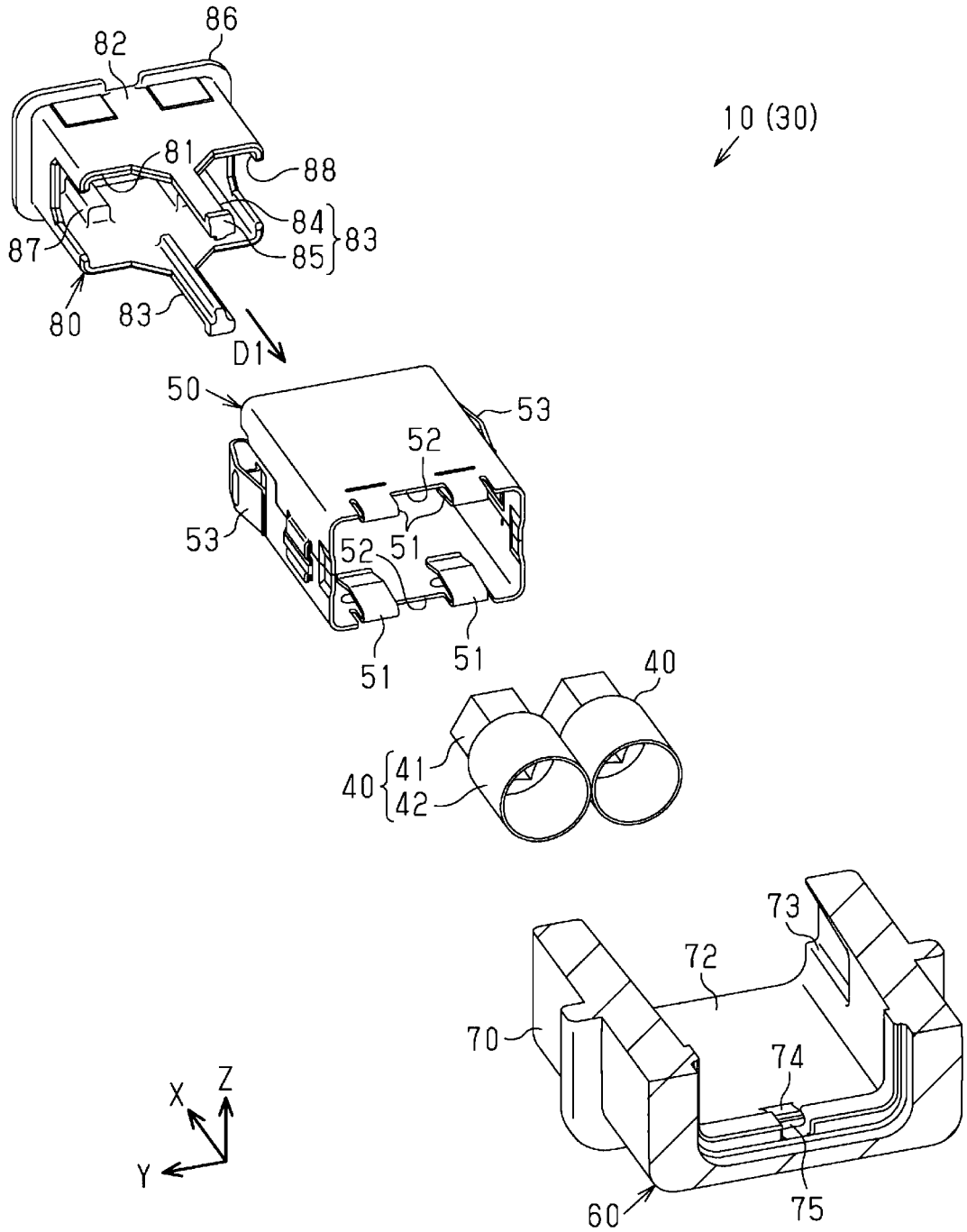
FIG. 6 is a schematic perspective view in section showing the connector of the one embodiment.

As shown in FIGS. 5 and 6, one or more (here, two) engaging portions 74 are provided on the inner surface of the accommodation space 72. The two engaging portions 74 are, for example, provided on the inner surface of the accommodation space 72 on a back side (here, rear side) in the inserting direction D1. The two engaging portions 74 are, for example, provided on the inner surface of the accommodation space 72 in a rear end part of the inserting portion 70. As shown in FIG. 5, the two engaging portions 74 are, for example, provided on two inner surfaces facing each other in the X-axis direction, out of the inner surface of the accommodation space 72. Each engaging portion 74 is, for example, formed to project radially inwardly of the inserting portion 70 from the inner surface of the accommodation space 72. Each engaging portion 74 is, for example, is formed to project in a direction (here, Z-axis direction) intersecting the inserting direction D1. Each engaging portion 74 extends along an axial direction (here, X-axis direction) of the inserting portion 70. Each engaging portion 74 has a rear end surface 75. The rear end surface 75 extends, for example, in a direction (here, Z-axis direction) intersecting the inserting direction D1. The engaging portion 74 is, for example, formed to increase a projection amount from the inner surface of the accommodation space 72 from a front end part of the engaging portion 74 toward the rear end surface 75. Thus, the inner surface of the engaging portion 74 is inclined to approach a center axis of the accommodation space 72 from the front end part of the engaging portion 74 toward the rear end surface 75.

(Configuration of Inner Shell 50)

Figure 7:
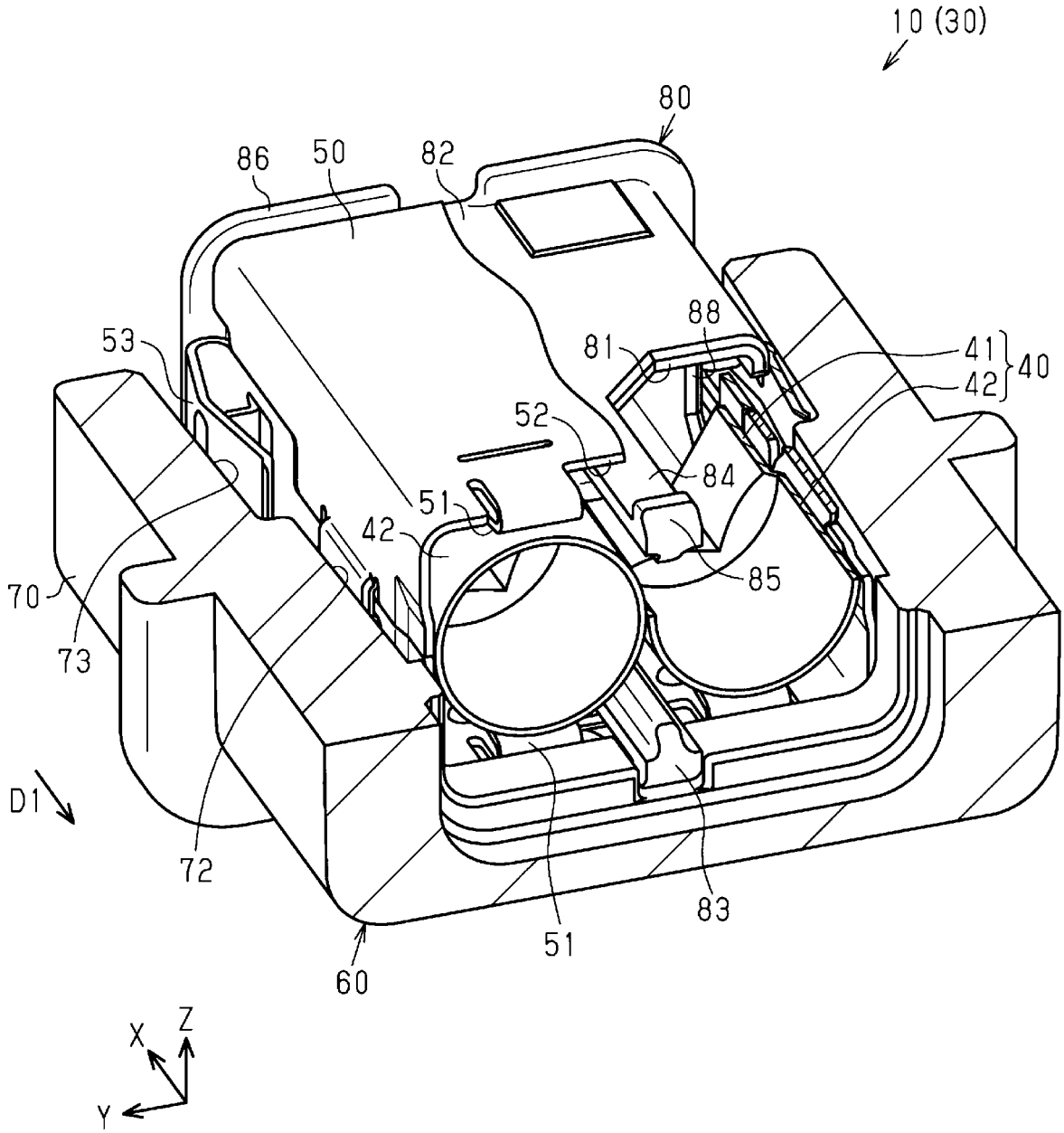
FIG. 7 is a schematic perspective view in section showing the connector of the one embodiment.

As shown in FIGS. 6 and 7, the inner shell 50 is, for example, formed into an annular shape extending in the X-axis direction. The inner shell 50 is, for example, formed into an annular shape having an outer surface shaped to correspond to the inner surface of the accommodation space 72. The outer and inner surfaces of the inner shell 50 are, for example, formed into a rectangular shape longer in the Y-axis direction than in the Z-axis direction. The inner shell 50 of this embodiment is formed into a rectangular annular shape. The inner shell 50 includes, for example, a bottom wall and an upper wall facing each other in the Z-axis direction and a pair of side walls facing each other in the Y-axis direction. The inner shell 50 has a front end surface (first end surface) and a rear end surface (second end surface) in the axial direction of the inner shell 50. A copper-based, aluminum-based or iron-based metal material can be, for example, used as a material of the inner shell 50.

As shown in FIG. 4, the inner shell 50 is accommodated inside the accommodation space 72. The inner shell 50 is, for example, provided between the inner surface of the accommodation space 72 and the shielded cables 20 and the interposing members 40 in a radial direction of the inserting portion 70. The inner shell 50 is provided to surround the outer peripheries of the plurality of shielded cables 20 inside the accommodation space 72. The inner shell 50 is, for example, provided to surround the outer peripheries of the interposing members 40 mounted on the outer peripheries of the plurality of shielded cables 20. For example, the inner shell 50 is provided to surround the outer peripheries of the plurality of shielded cables 20 and the plurality of interposing members 40 over the entire periphery in the circumferential direction inside the accommodation space 72. The inner shell 50 is in contact with the interposing members 40 and the outer shell 60. The inner shell 50 electrically connects the interposing members 40 and the outer shell 60. Note that the plurality of shielded cables 20 and the plurality of interposing members 40 are provided side by side along the Y-axis direction (first direction) intersecting the axial direction of the shielded cables 20 inside the inner shell 50.

As shown in FIG. 6, one or more (here, four) contact pieces 51 are, for example, provided inside the inner shell 50. The four connection pieces 51 are, for example, provided on the inner surface of the inner shell 50 on a back side (here, rear side) in the inserting direction D1. The four connection pieces 51 are, for example, provided on the inner surfaces of the bottom wall and the upper wall, out of the inner surface of the inner shell 50. Two connection pieces 51 are provided at an interval in the Y-axis direction on the inner surface of the bottom wall of the inner shell 50, and the remaining two connection pieces 51 are provided at an interval in the Y-axis direction on the inner surface of the upper wall of the inner shell 50. The respective connection pieces 51 provided on the inner surface of the bottom wall of the inner shell 50 and the respective connection pieces 51 provided on the inner surface of the upper wall of the inner shell 50 are facing each other in the Z-axis direction. As shown in FIG. 4, two connection pieces 51 facing each other in the Z-axis direction are provided across one interposing member 40. Each connection piece 51 is, for example, formed to be folded into an internal space of the inner shell 50 and forward from the rear end surface of the bottom wall or upper wall of the inner shell 50. Each connection piece 51 is configured to be resiliently deformable by being cantilevered and supported on the bottom wall or upper wall of the inner shell 50. Each connection piece 51 is in contact with the outer peripheral surface of the connecting portion 42 of the interposing member 40. In this way, each connection piece 51 is electrically connected to the interposing member 40. The inner shell 50 is electrically connected to the electromagnetic shield member 23 via the interposing member 40.

As shown in FIGS. 5 and 6, one or more (here, two) recesses 52 are provided in the rear end surface of the inner shell 50. Each recess 52 is, for example, formed to be recessed toward the front end surface of the inner shell 50 from the rear end surface of the inner shell 50. At least a part of the engaging portion 74 of the outer shell 60 is accommodated in each recess 52. As shown in FIG. 6, the two recesses 52 are, for example, respectively provided in the bottom wall and upper wall of the inner shell 50. The recesses 52 are, for example, provided between two connection pieces 51 provided side by side in the Y-axis direction in the bottom wall and upper wall of the inner shell 50. Thus, the engaging portion 74 to be accommodated into the recess 52 is provided between two connection pieces 51 in the Y-axis direction.

For example, one or more (here, two) contact pieces 53 are provided on the outer surface of the inner shell 50. The two contact pieces 53 are, for example, provided on the outer surface of the inner shell 50 on a front side in the inserting direction D1. The two contact pieces 53 are, for example, provided on the outer surfaces of a pair of side walls, out of the outer surface of the inner shell 50. Each contact piece 53 is, for example, formed to be folded outwardly and rearwardly of the inner shell 50 from the front end surface of the side wall of the inner shell 50. Each contact piece 53 is configured to be resiliently deformable by being cantilevered and supported on the side wall of the inner shell 50. Each contact piece 53 is in contact with the inner surface of the outer shell 60, specifically, the inner surface of the recess 73. In this way, each contact piece 53 is electrically connected to the outer shell 60.

(Configuration of Retainer 80)

The retainer 80 is, for example, inserted into the outer shell 60 along the inserting direction D1. The retainer 80 is, for example, held inside the accommodation space 72. The retainer 80 is mounted into the outer shell 60 while holding the inner shell 50 with the inner shell 50 held in contact with the inner surface of the outer shell 60. For example, the retainer 80 holds the inner shell 50 with the contact pieces 53 of the inner shell 50 held in contact with the inner surfaces of the recesses 73 of the outer shell 60. For example, the retainer 80 holds the inner shell 50 with the inner shell 50 held in contact with the outer surfaces of the interposing members 40. For example, the retainer 80 holds the inner shell 50 with the connection pieces 51 of the inner shell 50 held in contact with the outer surfaces of the connecting portions 42 of the interposing members 40. The retainer 80 is, for example, fit into the inner shell 50. For example, the retainer 80 holds the inner shell 50 from inside the inner shell 50. The retainer 80 includes a front end part (first end part) and a rear end part (second end part) in an axial direction (here, X-axis direction) of the retainer 80.

The retainer 80 is, for example, formed into an annular shape to be fit into the inner shell 50. The retainer 80 includes, for example, cut portions 81 provided in the rear end part of the retainer 80. The cut portions 81 are provided at parts of the retainer 80 in the circumferential direction. The retainer 80 includes an annular body portion 82 and one or more (here, two) engaging portions 83 provided on the body portion 82. The retainer 80 is, for example, a single component in which the body portion 82 and the engaging portions 83 are integrally formed while being connected in the axial direction of the retainer 80. The body portion 82 is, for example, provided in the front end part of the retainer 80. The engaging portions 83 are, for example, provided in the rear end part of the retainer 80. A synthetic resin such as polyolefin, polyamide, polyester or ABS resin can be, for example, used as a material of the retainer 80.

(Configuration of Body Portion 82)

The body portion 82 has, for example, an annular shape extending in the X-axis direction. The body portion 82 is, for example, formed into an annular shape having an outer surface shaped to correspond to the inner surface of the inner shell 50. The outer and inner surfaces of the body portion 82 are, for example, formed into a rectangular shape longer in the Y-axis direction than in the Z-axis direction. The body portion 82 of this embodiment is formed into a rectangular annular shape. The body portion 82 includes, for example, a bottom wall and an upper wall facing each other in the Z-axis direction and a pair of side walls facing each other in the Y-axis direction. The body portion 82 has a rear end surface (third end surface) and a front end surface in the axial direction (here, X-axis direction) of the body portion 82. When the retainer 80 is inserted into the inner shell 50, the facing outer surface of the body portion 82 and inner surface of the inner shell 50 are at least partially in contact with each other. A length in the axial direction of the body portion 82 is, for example, shorter than that of the inner shell 50.

The body portion 82 includes, for example, a projecting portion 86 projecting outwardly of the body portion 82 from the outer surface of the body portion 82. The projecting portion 86 is, for example, formed to protrude radially outwardly of the body portion 82 from the outer surface of a front end part of the body portion 82. The projecting portion 86 is formed to engage the rear end surface of the inner shell 50. The projecting portion 86 restricts a movement of the inner shell 50 in a direction opposite to the inserting direction D1. In this way, the detachment of the inner shell 50 from the outer shell 60 can be suppressed.

One or more (here, four) restricting walls 87 are, for example, provided on the inner surface of the body portion 82. The four restricting walls 87 are, for example, provided on the inner surface of the body portion 82 on a front side in the inserting direction D1. The four restricting walls 87 are, for example, provided on the inner surfaces of the bottom wall and upper wall, out of the inner surface of the body portion 82. Two restricting walls 87 are provided at an interval in the Y-axis direction on the inner surface of the bottom wall of the inner shell 50, and the remaining two restricting walls 87 are provided at an interval in the Y-axis direction on the inner surface of the upper wall of the body portion 82. As shown in FIG. 4, the respective restricting walls 87 provided on the inner surface of the bottom wall of the body portion 82 and the respective restricting walls 87 provided on the inner surface of the upper wall of the body portion 82 are facing each other in the Z-axis direction. Each restricting wall 87 is provided at a position facing the crimping portion 41 of the interposing member 40 in the X-axis direction. Each restricting wall 87 is formed to project radially inwardly of the body portion 82 from the inner surface of the body portion 82. Each restricting wall 87 is so formed that an interval between the two restricting walls 87 facing each other in the Z-axis direction is smaller than an outer diameter of the crimping portion 41 of the interposing member 40. The rear end surface of each restricting wall 87 is formed to be engageable with the front end surface of the crimping portion 41. Each restricting wall 87 can restrict a movement of the interposing member 40 in the axial direction of the outer shell 60. In this way, each restricting wall 87 can, for example, position the interposing member 40 in the axial direction of the outer shell 60.

As shown in FIG. 6, one or more (here, two) recesses 88 are, for example, provided in the rear end surface of the body portion 82. The recesses 88 are provided in parts of the body portion 82 in the circumferential direction. Each recess 88 is, for example, formed to be recessed toward the front end surface of the body portion 82 from the rear end surface of the body portion 82. For example, each recess 88 is provided in each side wall of the body portion 82. As shown in FIG. 7, a part of the interposing member 40 is, for example, accommodated in each recess 88. A part of the crimping portion 41 in the circumferential direction is, for example, accommodated in the recess 88.

(Configuration of Engaging Portion 83)

As shown in FIG. 6, two engaging portions 83 are provided to correspond to the two engaging portions 74 of the outer shell 60. The respective engaging portions 83 are formed to engage the respective engaging portions 74 inside the outer shell 60.

The engaging portion 83 includes, for example, an engaging piece 84 extending along the axial direction of the retainer 80 from the rear end surface of the body portion 82. The engaging piece 84 is, for example, provided in a part of the body portion 82 in the circumferential direction. The engaging piece 84 is, for example, formed to extend rearward along the inserting direction D1 from the rear end surface of the bottom wall or upper wall of the body portion 82. Each engaging piece 84 is, for example, provided in a central part of the bottom wall or upper wall of the body portion 81 in the Y-axis direction. As shown in FIG. 2, each engaging piece 84 is, for example, provided in a clearance between two shielded cables 20 in the Y-axis direction in which the two shielded cables 20 are arranged. As shown in FIG. 7, each engaging piece 84 is provided in a clearance between two interposing members 40 in the Y-axis direction. Each engaging piece 84 is, for example, provided in the clearance formed when the two annular interposing members 40 (connecting portions 41) are provided side by side. Each engaging piece 84 is, for example, provided at a position overlapping the recess 52 of the inner shell 50 in the Z-axis direction. The two engaging pieces 84 are facing each other in the Z-axis direction. Each engaging piece 84 includes a base end part (here, front end part) and a tip part (here, rear end part) in the axial direction of the engaging piece 84. The base end part of each engaging piece 84 is connected to the rear end surface of the body portion 82. Each engaging piece 84 is in the form of a cantilever with the base end part as a fixed end and the tip part as a free end. Each engaging piece 84 is springy. Each engaging piece 84 is configured to be so resiliently deformable that the tip part of the engaging piece 84 is shifted in the Z-axis direction with respect to the base end part of the engaging piece 84. The tip part of each engaging piece 84 is, for example, formed to project further rearward than the rear end surface of the inner shell 50. The tip part of each engaging piece 84 is, for example, exposed from the inner shell 50.

As shown in FIG. 5, an engaging projection 85 projecting radially outwardly of the retainer 80 from the outer surface of each engaging piece 84 is formed on the tip part of each engaging piece 84. Each engaging projection 85 is, for example, formed to project in a direction (here, Z-axis direction) intersecting the inserting direction D1. Each engaging projection 85 is formed to be engageable with the engaging portion 74 of the outer shell 60. Each engaging projection 85 is, for example, formed to be engageable with the rear end surface 75 of the engaging portion 74.

As shown in FIG. 6, the cut portions 81 are, for example, formed by the rear end surface of the body portion 82 and the engaging pieces 84. In other words, the cut portions 81 are formed in parts of the retainer 80 in the circumferential direction where the engaging pieces 84 are not formed. The cut portions 84 are, for example, formed to communicate with the recesses 88. The cut portions 81 are, for example, formed to expose the inner surface of the inner shell 50. The cut portions 81 are, for example, formed to expose the connection pieces 51 of the inner shell 50. As shown in FIG. 7, the interposing members 40 are, for example, in contact with the connection pieces 51 of the inner shell 50 exposed from the cut portions 81.

As shown in FIG. 6, the inner shell 50 and the retainer 80 are inserted into the accommodation space 72 of the outer shell 60 from front along the inserting direction D1. For example, the inner shell 50 and the retainer 80 are inserted into the accommodation space 72 with the retainer 80 inserted inside the inner shell 50. At this time, the respective engaging pieces 84 of the retainer 80 are pressed by the engaging portions 74 of the outer shell 60 to be resiliently deformed and deflected radially inwardly of the retainer 80. That is, the two engaging pieces 84 are deflected toward each other. Thereafter, the respective engaging pieces 84 are resiliently restored to engage the engaging projections 85 with the rear end surfaces 75 of the engaging portions 74 when the engaging projections 85 are inserted further rearward than the rear end surfaces 75 of the engaging portions 74. In this way, the retainer 80 is mounted into the outer shell 60 and held inside the outer shell 60. Here, the retainer 80 is fit inside the inner shell 50 and holds the inner shell 50 from inside the inner shell 50. Thus, the inner shell 50 can be held inside the outer shell 60 by the retainer 80 by mounting the retainer 80 into the outer shell 60. At this time, the retainer 80 holds the inner shell 50 with the contact pieces 53 of the inner shell 50 held in contact with the inner surfaces of the recesses 73 of the outer shell 60. Further, the projecting portion 86 of the retainer 80 is engaged with the front end surface of the inner shell 50. In this way, a movement of the inner shell 50 in the direction opposite to the inserting direction D1 can be restricted. Thereafter, as shown in FIG. 4, the interposing member 40 mounted on the outer periphery of the shielded cable 20 is inserted into the inner shell 50 from behind along the direction opposite to the inserting direction D1. At this time, a movement of the interposing member 40 in the X-axis direction is restricted by the restricting walls 87 of the retainer 80. The connection pieces 51 of the inner shell 50 exposed from the cut portion 87 of the retainer 80 are brought into contact with the outer surface of the connecting portion 42 of the interposing member 40. In this way, the interposing member 40 is electrically connected to the inner shell 50 and the inner shell 50 is electrically connected to the outer shell 60. Therefore, the electromagnetic shield member 23 electrically connected to the interposing member 40 is electrically connected to the outer shell 60 through the interposing member 40 and the inner shell 50.

Next, functions and effects of this embodiment ae described.

(1) The connector includes the shielded cables 20, the conductive interposing members 40 to be mounted on the shielded cables 20, the conductive inner shell 50 for covering the interposing members 40, the conductive annular outer shell 60 for covering the inner shell 50, and the retainer 80 made of synthetic resin and to be mounted into the outer shell 60. The interposing members 40 are in contact with the electromagnetic shield members 23 exposed from the insulation coatings 24 and the inner shell 50. The inner shell 50 is in contact with the interposing members 40 and the outer shell 60. The retainer 80 holds the inner shell 50 with the inner shell 50 held in contact with the inner surface of the outer shell 60.

According to this configuration, the electromagnetic shield members 23 and the inner shell 50 are electrically connected by the interposing members 40, and the interposing members 40 and the outer shell 60 are electrically connected by the inner shell 50. In this way, the electromagnetic shield members 23 are electrically connected to the outer shell 60 via the interposing members 40 and the inner shell 50. Further, the retainer 80 holds the inner shell 50 and is mounted in the outer shell 60 with the inner shell 50 held in contact with the inner surface of the outer shell 60. In this way, the inner shell 50 can be held in contact with the inner surface of the outer shell 60 by mounting the retainer 80 made of synthetic resin into the outer shell 60. Thus, a contact state of the inner shell 50 and the outer shell 60 can be suitably maintained. Therefore, a reduction in shielding performance by the inner shell 50, the outer shell 60 and the like can be suitably suppressed. At this time, since the retainer 80 made of synthetic resin is mounted into the outer shell 60, a structure of the outer shell 60 for holding the retainer 80 can be simple. In other words, structural restrictions of the outer shell 60 can be relaxed.

(2) If a structure for mounting in the outer shell 60 is set in the retainer 80 made of synthetic resin, a structure for mounting in the outer shell 60 needs not be set in the inner shell 50. Further, since the inner shell 50 is held by the retainer 80, a structure for holding the inner shell 50 needs not be set in the outer shell 60. Thus, complicated structures need not be set in the inner shell 50 and the outer shell 60. Therefore, structural restrictions of the inner shell 50 and the outer shell 60 can be relaxed.

(3) The engaging portions 74 of the outer shell 60 and the engaging portions 83 of the retainer 80 are engaged inside the annular outer shell 60. Thus, engaged parts of the outer shell 60 and the retainer 80 are arranged inside the outer shell 60. In this way, unintended touch of a worker with the engaged parts of the outer shell 60 and the retainer 80, for example, during an assembling operation can be suppressed. Thus, unintended disengagement of the outer shell 60 and the retainer 80 can be suppressed, and the detachment of the retainer 80 from the outer shell 60 can be suppressed. As a result, electrical disconnection of the inner shell 50 held by the retainer 80 and the outer shell 60 can be suppressed. That is, the stability of electrical connection of the inner shell 50 and the outer shell 60 can be improved.

(4) The retainer 80 is provided with the cut portions 81. In this way, the interposing members 40 can be brought into contact with the inner surface of the inner shell 50 exposed from the cut portions 81. Thus, contact parts of the interposing members 40 and the inner shell 50 can be provided at positions overlapping the retainer 80 in the axial direction of the shielded cables 20. In this way, the connector 30 can be reduced in size in the axial direction of the shielded cables 20 as compared to the case where the retainer 80 is not provided with the cut portions 81.

(5) The engaging pieces 84 are provided in the clearance between the plurality of shielded cables 20. In other words, the engaging pieces 84 are provided in a dead space formed when the plurality of shielded cables 20 are provided side by side in the Y-axis direction. Thus, the enlargement of the connector 30 due to the provision of the retainer 80 can be suppressed.

(6) The inner shell 50 is provided with the recesses 52 capable of accommodating at least parts of the engaging portions 74 of the outer shell 60. Thus, the interference of the engaging portions 74 and the inner shell 50 inside the outer shell 60 can be suppressed. In this way, at least parts of the engaging portions 74 can be provided at positions overlapping the inner shell 50 in the axial direction of the shielded cables 20. As a result, the connector 30 can be reduced in size in the axial direction of the shielded cables 20 as compared to the case where the inner shell 50 is not provided with the recesses 52.

OTHER EMBODIMENTS

The above embodiment can be modified and carried out as follows. The above embodiment and the following modifications can be combined with each other without technical contradiction and carried out.

In the inner shell 50 of the above embodiment, the recesses 52 may be omitted.

Although the inner shell 50 of the above embodiment is in contact with the outer surfaces of the interposing members 40 via the connection pieces 51, there is no limitation to this. For example, structures other than the connection pieces 51 can be employed if the structures can contact the outer surfaces of the interposing members 40.

Although the inner shell 50 of the above embodiment is in contact with the inner surface of the outer shell 60 via the contact pieces 53, there is no limitation to this. For example, structures other than the contact pieces 53 can be employed if the structures can contact the inner surface of the outer shell 60.

The structure of the inner shell 50 in the above embodiment is not limited to the annular structure.

In the retainer 80 of the above embodiment, the recesses 88 may be omitted.

In the retainer 80 of the above embodiment, the restricting walls 87 may be omitted.

In the retainer 80 of the above embodiment, the projecting portion 86 may be omitted.

In the retainer 80 of the above embodiment, the cut portions 81 may be omitted.

Although the engaging projections 85 provided on the tip parts of the engaging pieces 84 are engaged with the engaging portions 74 of the outer shell 60 in the retainer 80 of the above embodiment, there is no limitation to this. For example, the structures of the engaging portions 83 are not particularly limited as long as the engaging portions 83 are engageable with the engaging portions 74.

Although the engaging portions 74 are formed to project inward from the inner surface of the outer shell 60 in the above embodiment, there is no limitation to this. For example, the engaging portions 74 may be formed to be recessed radially outwardly of the outer shell 60 from the inner surface of the outer shell 60.

The structure of the retainer 80 in the above embodiment is not limited to the annular structure.

Although the interposing members 40, the inner shell 50 and the retainer 80 are accommodated in the accommodation space 72, which is an internal space of the inserting portion 70, in the above embodiment, there is no limitation to this. For example, the interposing members 40, the inner shell 50 and the retainer 80 may be accommodated in the accommodation hole 62, which is an internal space of the outer arrangement portion 61.

Although the electromagnetic shield member 23 exposed from the insulation coating 24 is folded rearward in the above embodiment, there is no limitation to this. For example, the exposed portion 25 of the electromagnetic shield member 23 and the crimping portion 41 of the interposing member 40 may be connected on the sheath 22 without folding the electromagnetic shield member 23 exposed from the insulation coating 24. In this case, the underlay member 26 may be inserted between the exposed portion 25 and the sheath 22.

The underlay member 26 in the above embodiment may be omitted.

In the above embodiment, the number of the shielded cables 20 passed through the outer shell 60 may be one, three or more. The number of the interposing members 40 can be changed according to the number of the shielded cables 20.

The shield connection structure formed by the shielded cables 20, the interposing members 40, the inner shell 50, the outer shell 60 and the retainer 80 in the above embodiment can also be applied to a connection device other than the connector 30. The connection device is, for example, fit into a mounting hole provided in a case for accommodating an in-vehicle device.

The embodiment disclosed this time should be considered illustrative rather than restrictive in all aspects. The scope of the invention is intended to be represented not by the meanings described above, but by claims and include all changes in the scope of claims and in the meaning and scope of equivalents.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A shield connection structure, comprising:

a shielded cable;

a conductive interposing member to be mounted on the shielded cable;

a conductive inner shell for covering the interposing member;

a conductive annular outer shell for covering the inner shell; and a retainer made of synthetic resin, the retainer being mounted into the outer shell, wherein:

the shielded cable includes a conductive core, an insulating sheath for surrounding an outer periphery of the core, a conductive electromagnetic shield member for surrounding an outer periphery of the sheath and an insulating insulation coating for surrounding an outer periphery of the electromagnetic shield member, the interposing member contacts the electromagnetic shield member exposed from the insulation coating and the inner shell and electrically connects the electromagnetic shield member and the inner shell, the inner shell contacts the interposing member and the outer shell and electrically connects the interposing member and the outer shell, and the retainer holds the inner shell with the inner shell held in contact with an inner surface of the outer shell.

2. The shield connection structure of claim 1, wherein:

the outer shell includes a first engaging portion provided on the inner surface of the outer shell, and the retainer includes a second engaging portion to be engaged with the first engaging portion inside the outer shell.

3. The shield connection structure of claim 2, wherein:

the inner shell is formed into an annular shape to be fit inside the outer shell, the inner shell has a first end surface and a second end surface in an axial direction of the inner shell, the retainer includes a first end part and a second end part in an axial direction of the retainer, the retainer includes a projecting portion formed to project outward from an outer surface of the first end part of the retainer, the projecting portion is engaged with the first end surface of the inner shell, and the second engaging portion is provided on the second end part of the retainer.

4. The shield connection structure of claim 3, wherein:

the retainer is formed into an annular shape to be fit inside the inner shell, the retainer includes a cut portion provided in the second end part of the retainer, the cut portion is provided in a part of the retainer in a circumferential direction, and the interposing member is in contact with an inner surface of the inner shell exposed from the cut portion.

5. The shield connection structure of claim 4, wherein:

the retainer includes an annular body portion, the body portion has a second end surface provided on the second end part of the retainer, the third end surface being an end surface in an axial direction of the body portion, the second engaging portion includes an engaging piece extending along the axial direction of the retainer from the third end surface of the body portion and projecting further than the second end surface of the inner shell, the engaging piece is provided on a part of the body portion in the circumferential direction, the engaging piece includes a base end part and a tip part in the axial direction of the retainer, the base end part of the engaging piece is connected to the third end surface of the body portion, the tip part of the engaging piece is engaged with the first engaging portion of the outer shell, and the cut portion is formed by the third end surface of the body portion and the engaging piece.

6. The shield connection structure of claim 5, wherein:

the body portion includes a first recess provided in the third end surface of the body portion, the first recess is provided in a part of the body portion in the circumferential direction, and a part of the interposing member is accommodated in the first recess.

7. The shield connection structure of claim 5, wherein:

a plurality of the shielded cables pass through inside of the inner shell, the plurality of shielded cables are provided side by side along a first direction intersecting an axial direction of the shielded cables, and the engaging piece is provided in a clearance between the plurality of shielded cables in the first direction.

8. The shield connection structure of claim 5, wherein:

the retainer includes a restricting wall projecting inward from an inner surface of the first end part of the body portion, and the restricting wall is engaged with one end surface in the axial direction of the interposing member.

9. The shield connection structure of claim 3, wherein:

the first engaging portion is formed to project radially inwardly of the outer shell from the inner surface of the outer shell, the inner shell includes a second recess provided in the second end surface of the inner shell, and at least a part of the first engaging portion is accommodated in the second recess.

* * * * *